US010712050B2

(12) United States Patent
Van Bael

(10) Patent No.: US 10,712,050 B2
(45) Date of Patent: Jul. 14, 2020

(54) MULTI-STAGE HEAT ENGINE

(71) Applicant: VLAAMSE INSTELLING VOOR TECHNOLOGISCH ONDERZOEK (VITO), Mol (BE)

(72) Inventor: Johan Van Bael, Westerlo (BE)

(73) Assignee: VLAAMSE INSTELLING VOOR TECHNOLOGISCH ONDERZOEK (VITO), Mol (BE)

( * ) Notice: Subject to any disclaimer, the term of this patent is extended or adjusted under 35 U.S.C. 154(b) by 500 days.

(21) Appl. No.: 15/312,555

(22) PCT Filed: May 22, 2015

(86) PCT No.: PCT/EP2015/061431
§ 371 (c)(1),
(2) Date: Nov. 18, 2016

(87) PCT Pub. No.: WO2015/177352
PCT Pub. Date: Nov. 26, 2015

(65) Prior Publication Data

US 2017/0089612 A1 Mar. 30, 2017

(30) Foreign Application Priority Data

May 23, 2014 (EP) ..... 14169727

(51) Int. Cl.
*F25B 43/00* (2006.01)
*F25B 1/10* (2006.01)

(52) U.S. Cl.
CPC ..... *F25B 1/10* (2013.01); *F25B 43/006* (2013.01); *F25B 2400/23* (2013.01); *F25B 2600/2513* (2013.01)

(58) Field of Classification Search
CPC .. F25B 1/10; F25B 43/006; F25B 2600/2513; F25B 2400/23
See application file for complete search history.

(56) References Cited

U.S. PATENT DOCUMENTS 4,457,768 A 7/1984 Bellinger
2010/0139298 A1* 6/2010 Lifson ..... F04B 35/01 62/115
2012/0227427 A1* 9/2012 Liu ..... F25B 1/10 62/115

FOREIGN PATENT DOCUMENTS

CN 200940968 Y 8/2007
GB 2049901 A 12/1980
(Continued)

OTHER PUBLICATIONS

English Translation of WO 2014/091909 (Year: 2014).*
(Continued)

*Primary Examiner* — David J Teitelbaum
(74) *Attorney, Agent, or Firm* — Bacon & Thomas, PLLC

(57) ABSTRACT

A multi-stage heat engine having an evaporator, a condenser, expander stages; vapour compression stages; tanks for holding gaseous phases of a fluid. The compressor stages is adapted to compress the gaseous phase in the adjacent tank with a higher pressure than which occurred at expansion and to move the compressed fluid to the next adjacent tank at a higher pressure, the expander stages are adapted to expand a part of the compressed fluid in each tank, to expand the fluid in the adjacent tank at a lower pressure, the compressor and expander sections are adapted to output the gaseous phase at the highest pressure to the condenser and the liquid phase at the lowest pressure to the evaporator, where the output of the condenser are fed back to the tank at the highest pressure and the output of the evaporator is fed back to the tank at the lowest pressure.

18 Claims, 3 Drawing Sheets

(56) References Cited

FOREIGN PATENT DOCUMENTS

| | | | | |
|---|---|---|---|---|
| KR | 2008-0012638 | A | 2/2008 | |
| WO | WO-2014091909 | A1 * | 6/2014 | ..... F25B 1/10 |

OTHER PUBLICATIONS

International Search Report (ISR) dated Sep. 2, 2015, for PCT/EP2015/061431.
Written Opinion dated Sep. 2, 2015, for PCT/EP2015/061431.
European Extended Search Report dated Nov. 3, 2014, for EP 14169727.6.
Chinese Office Action in related Chinese Application No. 201580026698.7, dated Aug. 28, 2018.

* cited by examiner

MULTI-STAGE HEAT ENGINE

The present invention relates to a compact and expandable multi-stage heat engine such as a heat pump or in an analogous way a Rankine cycle generator, a process for increasing the temperature of a medium using such an engine and the use of such an engine for transformation of heat energy from renewable energy sources to higher temperatures or in a cooling method or installation to lower temperatures. The present invention also includes a combination of heating and cooling methods and installations. If there is a demand for cooling and heating both the cooling energy and the heating energy of the multi stage heat pump can be used. A cooling installation is also a heat pump.

BACKGROUND OF THE INVENTION

Heat pumps are used to bring heat at a low temperature to a higher (usable) temperature level e.g. heat from the ground or groundwater to be raised to a usable temperature level for under-floor heating. Commercial systems are so-called single stage heat pumps, see FIG. 1. Between the evaporator and the condenser there is one stage (one compressor and one expansion valve).

FIG. 2 shows a theoretical plot of log p versus h, where p is the pressure and h is the enthalpy, for a single stage heat pump cycle with a dome-like region, the so-called liquid-vapour dome, and the cycle for a single stage heat pump: the lower horizontal line with an arrow pointing to the right representing the evaporation step, followed by compression step, a condensation step (upper horizontal line with arrow pointing to the left) and finally expansion at constant enthalpy (vertical line with arrow pointing downwards). At lower enthalpies than those within the dome-like region (the so-called liquid-vapour dome) (i.e. to the left thereof) liquid exists with a mix of saturated liquid and saturated vapour in the dome-like region and vapour existing at higher enthalpies than those within the dome region (i.e. to the right thereof). The critical point is at the apex of the dome region with vapour existing to the non-dome-like area to the left thereof, a vapour existing in the non-dome-like area to the right thereof and a supercritical fluid existing above the critical point.

For larger temperature lifts, i.e. the difference between the temperature of the heat source and the output temperature of the heat pump, two stage heat pumps can be used comprising an additional intermediate pressure level, two compressors and two expansion valves. The advantage of two stages is that the pressure ratio which has to be realised by each of the compressors is halved compared with that for a single stage system. Furthermore, gas compressed in the first stage can be cooled, whereupon the density increases and the temperature of the gas at the second stage decreases. The performance of the second compression step can then be improved.

However, two stage systems have only been used for high temperature lifts because of the investment costs involved. Purely on the basis of energy considerations two stage systems are also of interest for lower temperature lifts. FIG. 3 shows a theoretical plot of log p versus h, where p is the pressure and h is the enthalpy, for a two stage heat pump cycle with the same liquid-vapour dome as for FIG. 2. Three stage systems are known for cryogenic applications. The greater the number of stages the higher will be the performance of a heat pump, but with the disadvantage that the investment required increases considerably.

GB 2049901A discloses a heat pump apparatus, comprising: a plurality of separate heat pump circuits, each of the said circuits being adapted to have a heat transferring fluid circulate therethrough and each including respective evaporator means and condenser means, and means for directing a mass flow to be heated into heat exchange relationship with each of the said condenser means in series, whereby the temperature of the mass flow to be heated rises when in heat exchange relationship with the fluids circulating through the condenser means of the respective heat pump circuits. To increase efficiency, a number of separate and continuously heat pump circuits are used, their compressors having a common drive, while the condensers are connected in series in relation to the current to be heated so as to cause its temperature to rise by heat-exchange with the media flowing in the pump circuits.

SUMMARY OF THE INVENTION

It is an object of the present invention to provide an alternative multi-stage heat engine or method such as a multistage heat pump, a cooling installation or method, a combination of a cooling installation and a heating installation or method or in an analogous way to a multistage Rankine cycle generator.

An advantage of embodiments of the present invention is that the compression of the medium proceeds in different steps increasing the theoretical efficiency of the compression.

Another advantage of embodiments of the present invention is that after each compressor step the liquid medium is cooled by evaporating a small fraction thereof and admixing the vapour thereby produced after expansion in the respective step. As a result the liquid medium has a higher density due to more mass per unit volume being compressed and a greater mass is transported. In particular in at least one of the stages the compression step places the compressed fluid vapour in a superheated state. The cooling of this superheated vapour by the admixture with evaporated fluid fed back from a higher stage brings the fluid back to a non-superheated or saturated state or a state close thereto. In particular the multistage heat pump of embodiments of the present invention is controlled in such a way that at least one of the stages is operated close to saturation. Preferably all the stages where there is compression and some expansion of fluid returned from a higher pressure tank are operated close to saturation.

A further advantage of embodiments of the present invention is that in each stage where there is an intermediate expansion of a portion of the fluid fed back from a higher stage the vapour formed is not only close to saturation but is immediately extracted and compressed back under high pressure to the next stage (finally to the highest pressure i.e. the condenser pressure). As a result this gas does not need to be compressed from the lowest pressure (evaporator pressure) to the highest pressure (condenser pressure). The use of smaller compression ratios in the stages means that each compressor operates more efficiently.

A still further advantage of embodiments of the present invention is that upon cooling a liquid medium heat can be exchanged in steps, whereby the temperature difference between cooling medium and the medium to be cooled is more or less constant. The same reasoning is also applicable to the heating of the liquid medium.

A further advantage of embodiments of the present invitation is that cooling can be delivered to different cooling consumers at different temperatures. Cooling at the lowest temperature is delivered by Tx, cooling at a higher temperature is delivered by the fluid in the appropriate tank. The same reasoning is also applicable to the heating of different consumers at different temperatures.

A still further advantage of the present invention is that a rough calculation of the COP (Coefficient of Performance, being the ratio of the thermal power delivered (i.e. the heat produced) and the required compressor power (i.e. the electricity consumption of the compressor) in multi-stage systems can be double that of a single stage system. A multi-stage system would thus consume half the energy of a single stage system. The same reasoning applies to cooling installations with compressors in that the working principles for a compressor cooling installation are the same as those for a heat engine such as a multistage heat pump or in an analogous way a multistage Rankine cycle generator, or a combination of heating and cooling methods and installations. If there is a demand for cooling and heating both the cooling energy and the heating energy of the multi stage heat pump can be used. A cooling installation is also a heat pump.

A still further advantage of embodiments of the present invention is an increase the efficiency of the compression of the vapour.

A first aspect of embodiments of the present invention is the provision of a multi-stage heat engine such as a multi-stage heat pump (e.g. a heating installation or a cooling installation or a combination of a heating and cooling installation) or in an analogous way a multistage Rankine cycle generator comprising an evaporator and a condenser; an expander section including more than two expander stages; a compressor section comprising more than two vapour compression stages that co-operate with the expander section; x tanks wherein x is at least three (e.g. T1 to Tx) for holding gaseous phases (e.g. G1 to Gx) and liquid phases (e.g. L1 to Lx) of a fluid; the expander section having x−1 expansion valves (e.g. V1 to Vx−1), the compressor section being adapted to compress the gaseous phase in each tank and to pass to an adjacent tank with a higher pressure to that in which expansion had occurred and move the compressed fluid to the next adjacent tank at a higher pressure, the expander section being adapted to expand a part of the compressed fluid (liquid) in each tank, through the expansion valve (V) of that tank, to expand the fluid in the adjacent tank at a lower pressure, the compressor and expander sections being adapted to output the gaseous phase at the highest pressure to the condenser and the liquid phase at the lowest pressure to the evaporator, the output of the condenser being fed back to tank (T1) at the highest pressure and the output of the evaporator being fed back to the tank (Tx) at the lowest pressure. Optionally said multi-stage heat engine such as a multistage heat pump (e.g. a heating installation or a cooling installation or a combination of a heating and cooling installation) or in an analogous way a multistage Rankine cycle generator constitutes multiple evaporator-compressor-condenser-expander modules which are substantially identical to one another. In particular the multistage heat engine such as a multistage heat pump (e.g. a heating installation or a cooling installation or a combination of a heating and cooling installation) or in an analogous way a multistage Rankine can comprise three of more tanks which are integrated into a whole rather than being a collection of separate heat engine circuits such as multistage heat pump circuits ((e.g. a heating circuits or a cooling circuits or a combination of a heating and cooling circuits) or in an analogous way a multistage Rankine cycle generator circuits. In effect there is one multistage heat engine circuit such as a multistage heat pump (e.g. a heating installation or a cooling installation or a combination of a heating and cooling installation) or in an analogous way a multistage Rankine cycle generator circuit which comprises sub-circuits.

A further aspect of embodiments of the present invention is that the compression of vapour in at least one tank places the compressed vapour in a superheated state and the expansion of the fluid from an adjacent tank, which is at a higher pressure, in the at least one tank at a lower pressure brings the vapour in this latter tank at a saturated or close to saturated state. Preferably at every compression stage where there is expansion of some liquid returned from a higher pressure tank, the cooling effect of this expansion keeps the vapour in that tank at or close to saturated. Hence, in any or every tank the liquid/vapour stage can be within the liquid vapour dome.

A further aspect of embodiments of the present invention is to bring the vapour at the suction side of each compressor to a saturated or close to saturated state, because this will increase the efficiency of the compression of the vapour.

A second aspect of embodiments of the present invention is the provision of a process for increasing the temperature of a medium, said process comprising the steps of: subjecting said medium to multiple evaporation-compression-condensation-expansion-cycles in a multi-stage heat engine such as a multistage heat pump (e.g. a heating installation or a cooling installation or a combination of a heating and cooling installation) or in an analogous way a multistage Rankine cycle generator according to the first aspect of the present invention.

Accordingly embodiments of the present invention provide process for increasing or decreasing the temperature of a medium, in a multi-stage heat engine comprising an evaporator and a condenser; an expander section including more than two expander stages; a compressor section comprising more than two vapour compression stages that co-operate with the expander section; x tanks wherein x is at least three (e.g. T1 to Tx) for holding gaseous phases (e.g. G1 to Gx) and liquid phases (e.g. L1 to Lx) of a fluid; the expander section having x−1 expansion valves (e.g. V1 to Vx−1), the method comprising: compressing the gaseous phase in a first tank to a higher pressure and moving the compressed fluid to a second next adjacent tank at a higher pressure, the expander section being adapted to expand a part of the compressed fluid (liquid) in the second next adjacent tank, through the expansion valve (V) of that tank, to expand the fluid in the first tank at a lower pressure, the compressor and expander sections being adapted to output the gaseous phase at the highest pressure to the condenser and the liquid phase at the lowest pressure to the evaporator, the output of the condenser being fed back to tank (T1) at the highest pressure and the output of the evaporator being fed back to the tank (Tx) at the lowest pressure.

The expansion of the fluid in the first tank at a lower pressure brings the vapour in this latter tank at a saturated or close to saturated state.

The compression of vapour in at least one tank places the compressed vapour in a superheated state.

At any or every compression stage where there is expansion of some liquid returned from a higher pressure tank, the cooling effect of this expansion keeps the vapour in that tank at or close to saturated.

Each or any tank can have pressure, and/or temperature and/or liquid level sensors and controllable expansion values; the method comprising regulating the controllable valves in accordance with the outputs of at least one of the sensors to maintain a level of liquid in each tank and maintain the vapour of each tank in a saturated state or close thereto.

The method can include driving a group of or all compressors axially by a single motor.

The method can include providing a direct connection between the pressure vessel and the pressure step in the compressor for each stage of the multiple-stage heat engine.

The method may include heating or cooling a liquid medium, whereby heat can be exchanged in steps, whereby the temperature difference between cooling or heating medium and the medium to be cooled or heated is more or less constant.

The method may include delivering cooling energy or heating energy is delivered to different consumers at different temperatures.

A further aspect of the method is to bring the vapour at the suction side of each compressor to a saturated or close to saturated state, because this will increase the efficiency of the compression of the vapour.

A third aspect of embodiments of the present invention is the provision of the use of multi-stage heat engines such as a multistage heat pumps (e.g. heating installations or cooling installations or a combination of a heating and cooling installations) or in an analogous way a multistage Rankine cycle generators, according to the first aspect of the present invention, in the transformation of the heat from renewable energy sources or residual heat to higher temperatures.

A fourth aspect of embodiments of the present invention is the provision of the use of multi-stage heat engines such as a multistage heat pumps (e.g. a heating installation or a cooling installation or a combination of a heating and cooling installation) or in an analogous way a multistage Rankine cycle generators, according to the first aspect of the present invention, in the transformation of residual heat e.g. the heat from wastewater.

A fifth aspect of the embodiments of the present invention is the provision of the use of multi-stage heat pumps, according to the first aspect of the present invention, for cooling applications or the combination of heating and cooling Particular and preferred aspects of the invention are set out in the accompanying independent and dependent claims. Features from the dependent claims may be combined with features of the independent claims and with features of other dependent claims as appropriate and not merely as explicitly set out in the claims.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
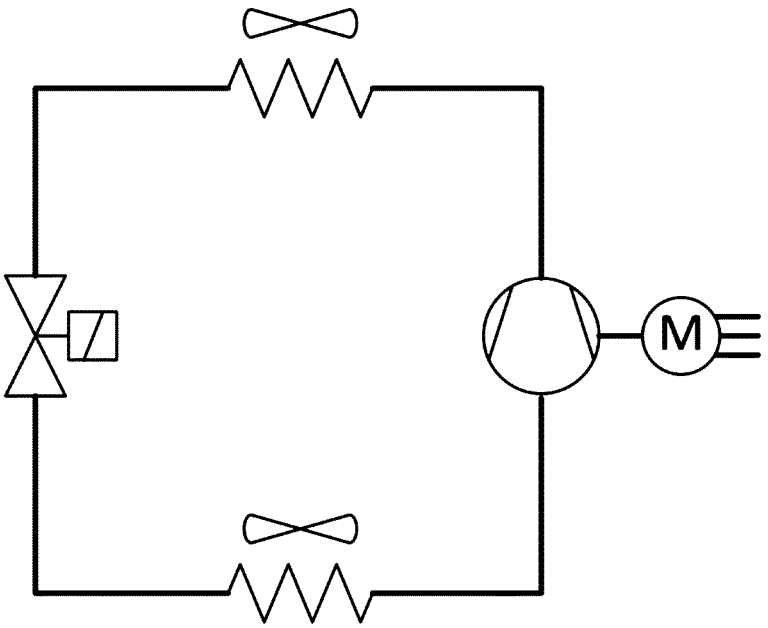
FIG. 1 is a schematic of the prior art, so-called single stage, heat pumps. Between the evaporator and the condenser there is only one stage (one compressor and one expansion valve).

In the different figures, the same reference signs refer to the same or analogous elements.

DETAILED DESCRIPTION OF THE INVENTION

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

The following terms are provided solely to aid in the understanding of the invention.

Definitions

A heat pump, as used in disclosing the present invention, is a device which transfers heat (hot or cold energy) from a cooler reservoir to a hotter one (or vice versa), expending mechanical energy in the process. The main purpose can be to heat the hot reservoir or to refrigerate the cold one. Both heating and cooling methods or installations and a combination of heating or cooling methods and installations are included within the scope of the present invention. For example, a multi stage heat pump can be used for cooling a cooler reservoir (heat is than wasted in the environment).

An integrated multi-stage heat pump, as disclosed as embodiments of the present invention, is a heat pump with multiple evaporation-compression-condensation-expansion cycle modules thereby providing an easily expandable compact heat pump. Such an installation may have one evaporator and one condenser but multiple compressors and expansion valves. The compressors for the stage or stages at high pressure can be smaller than the compressors for the stage or stages at lower pressure as the density of the vapour is lower at high pressure.

A compressor, as used in disclosing the present invention, is a machine for increasing the pressure of a gas or vapour.

A condenser, as used in disclosing the present invention, is a heat-transfer device that reduces a thermodynamic fluid from its vapour phase to its liquid phase, such as in a vapour-compression refrigeration plant or in a condensing steam power plant.

An evaporator, as used in disclosing the present invention, is any of many devices in which liquid is changed to the vapour state by the addition of heat, for example, distiller, still, dryer, water purifier, or refrigeration system element where evaporation proceeds at low pressure and consequent low temperature.

An expansion system, as used in disclosing the present invention, is a gas-liquid recovery system in which a cooling effect is obtained by rapidly depressurizing a liquid fraction.

Ground, as used in disclosing the present invention, embraces everything solid or molten below the earth's surface.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims. In particular the embodiments will be described with reference to multistage heat pump but the skilled person will appreciate that the teaching can be applied to a multistage heat pump for heating or cooling or a combination of a heating and cooling), in an analogous way a multistage Rankine cycle generator or other type of heat engine.

Heat Pump

According to a preferred embodiment of the first aspect of the present invention, the integral multi-stage heat pump a multistage heat pump for heating or cooling or a combination of a heating and cooling), comprises an evaporator and a condenser; an expander section including more than two expander stages; a compressor section comprising more than two vapour compression stages that co-operate with the expander section; at least three tanks (e.g. T1 to T10 but more or less can be used) for holding gaseous phases (e.g. G1 to G10 but more or less can be used) and liquid phases (e.g. L1 to L10 but more or less can be used) of a fluid; the expander section having expansion valves (e.g. V1 to V9 but more or less can be used), the compressor section being adapted to compress the gaseous phase (Gx+1) in each tank (Tx+1 with x being an integer between 1 and 9 but more or less can be used) and move the compressed fluid to the adjacent tank (Tx) at a higher pressure, the expander section being adapted to expand a part of the compressed fluid (liquid Ly) in each tank (Ty with y being an integer between 1 and 9 but more or less can be used), through the expansion valve (Vy) of that tank, to expand the fluid in the adjacent tank (Ty+1) at a lower pressure, the compressor and expander sections being adapted to output the gaseous phase at the highest pressure to the condenser and the liquid phase at the lowest pressure to the evaporator, the output of the condenser being fed back to tank (T1) at the highest pressure and the output of the evaporator being fed back to the tank (T10) at the lowest pressure.

A further aspect of embodiments of the present invention is that the compression of vapour in at least one tank places the compressed vapour in a superheated state and the expansion of the fluid in the adjacent tank at a lower pressure brings the vapour in this latter tank at a saturated or close to saturated state. Preferably at every compression stage where there is expansion of some liquid returned from a higher pressure tank, the cooling effect of this expansion keeps the vapour in that tank at or close to saturated. In particular each tank can include pressure, temperature and liquid level sensors and controllable expansion values. A controller is provided adapted to regulate the controllable valves in accordance with the outputs of the sensors to maintain a level of liquid in each tank and maintain the vapour of each tank in a saturated state or close thereto.

A further aspect of embodiments of the present invention is to bring the vapour at the suction side of each compressor to a saturated or close to saturated state, because this will increase the efficiency of the compression of the vapour. According to another preferred embodiment of the invention according to the first aspect of the present invention, the compressor section comprises a number of compressors driven axially by a single motor.

All or some of the compressors can be driven by one motor and an axial shaft. The compressors are not necessarily driven by an axial shaft.

Figure 4:
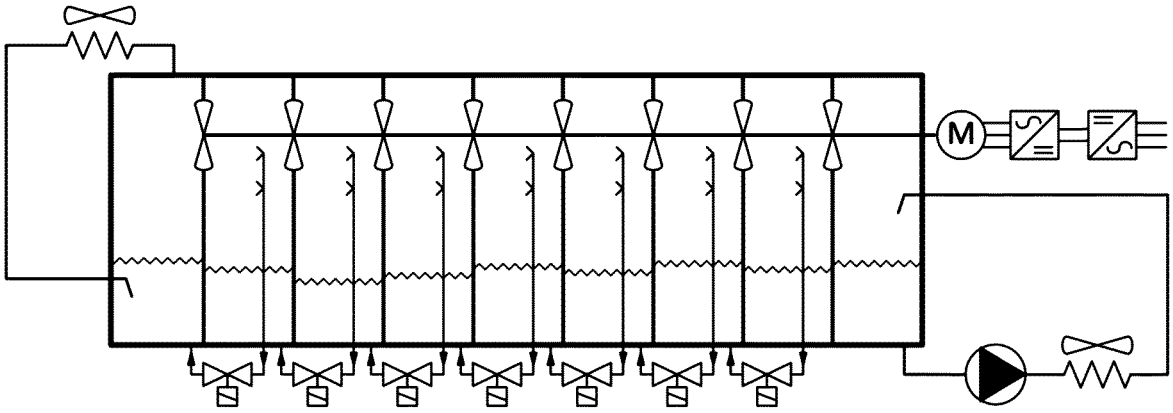
FIG. 4 is a schematic of an eight stage heat pump system comprising pressure vessels, compressors and expansion systems integrated into a single installation, a condenser, an evaporator and with the compressors driven axially by a single motor, according to an embodiment of the present invention.

FIG. 4 is a schematic of an eight stage heat pump system comprising pressure vessels (tanks T1 to T9 for holding gaseous phases G1 to G9 and liquid phases L1 to L9), compressors driven axially by a single motor, expansion systems (expansion valves V1 to V7), a condenser, an evaporator integrated into a single installation according to the present invention. The investment costs are considerably reduced compared with the classic arrangement with separate pressure vessels, compressors and expansion systems. By standardization the number of stages, and hence the temperature lift (or sink for cooling), is easily extendable. The different compression steps are here simply depicted by axially driven fans, although different systems are possible.

According to a further preferred embodiment of the first aspect of the present invention, a direct connection is provided between the pressure vessel and the pressure step in the compressor for each stage of the multiple-stage heat pump.

According to a further preferred embodiment of the first aspect of the present invention, the multiple-stage heat pump is integrated.

Figure 2:
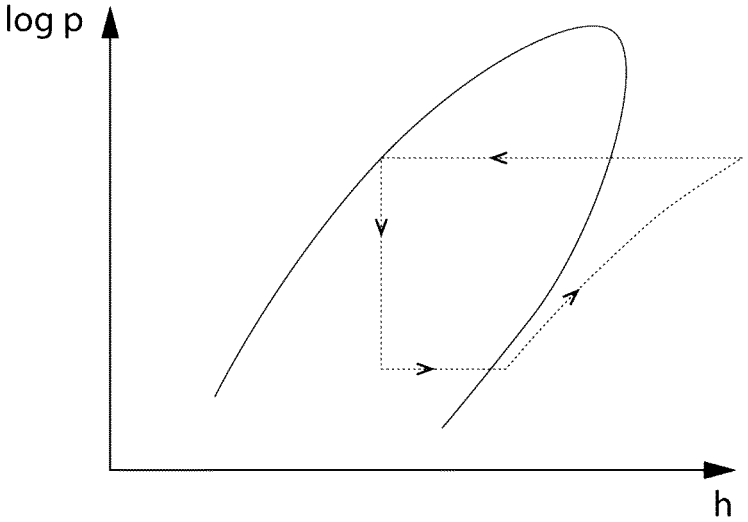
FIG. 2 is a theoretical plot of log p versus h, where p is the pressure and h is the enthalpy, for a single stage heat pump cycle.
Figure 3:
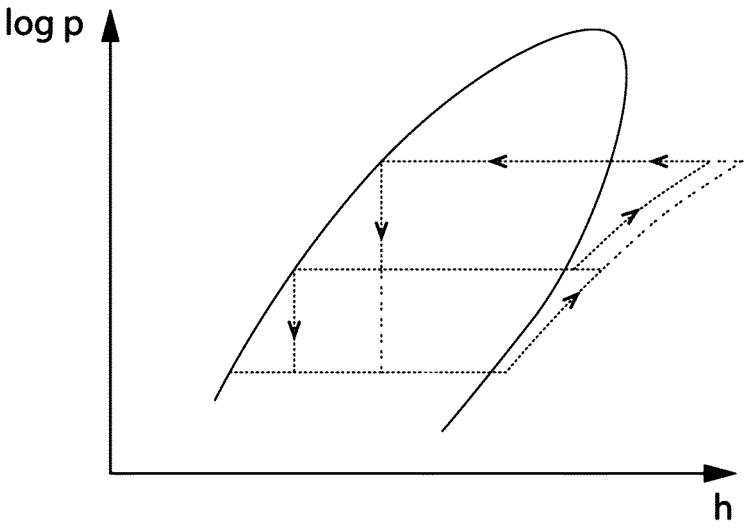
FIG. 3 is a theoretical plot of p versus h, where p is the pressure and h is the enthalpy, for a two stage heat pump cycle.
Figure 5:
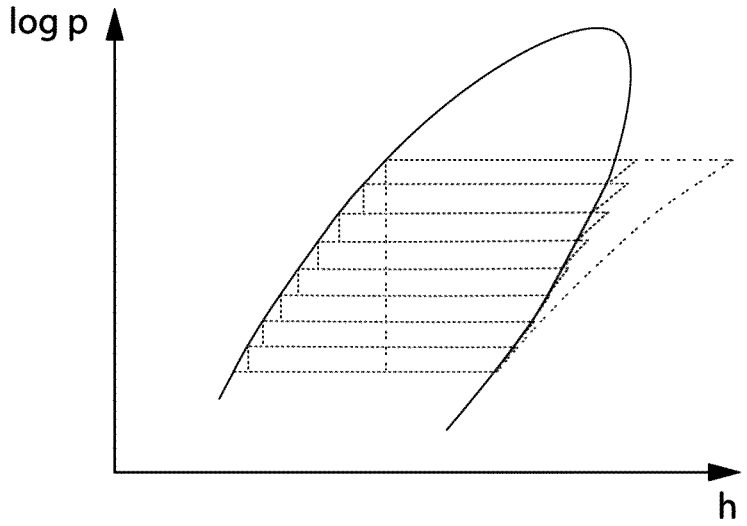
FIG. 5 is a theoretical plot of log p versus h, where p is the pressure and h is the enthalpy, for an eight stage heat pump cycle.

FIG. 5 is a theoretical plot of log p versus h, where p is the pressure and h is the enthalpy, for an eight stage heat pump cycle with the same liquid-vapour dome as for FIGS. 2 and 3. The greater the number of stages provided, the closer the compression proceeds in the co-existence region (on the gas side) and the closer the expansion proceeds in the co-existence region (on the liquid side).

Figure 6:
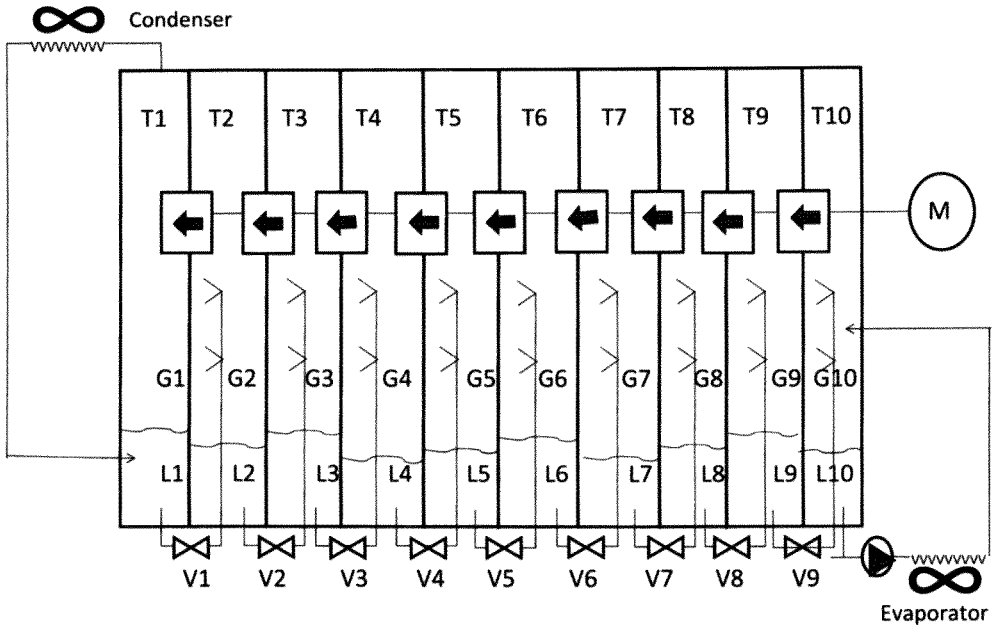
FIG. 6 is a schematic of a ten stage heat pump system, according to an embodiment of the present invention, with tanks T1 to T10 for holding gaseous phases G1 to G10 and liquid phases L1 to L10 of a fluid and expansion valves V1 to V9, a condenser, an evaporator and with the compressors driven axially by a single motor.

FIG. 6 is a schematic overview of a ten stage heat pump system, according to the present invention, with tanks T1 to T10 for holding gaseous phases G1 to G10 and liquid phases L1 to L10 of a fluid and expansion valves V1 to V9, a condenser, an evaporator and with the compressors driven axially by a single motor (although more motors may be used, e.g. groups of compressors may each be driven by one motor. It comprises condenser on the left side and an evaporator on the right side. The condenser is fed with gaseous phase of the system fluid such as ammonia at high pressure whereas the evaporator is fed with the liquid phase from a pump.

Use of Multi-Stage Heat Pumps

A third aspect of the present invention is the provision of the use of multi-stage heat pumps, (e.g. multistage heat pump for heating or cooling or a combination of a heating and cooling), according to the first aspect of the present invention, in the extraction of heat (hot or cold energy) from renewable energy sources, residual heat and wastewater.

A fourth aspect of the present invention is the provision of the use of multi-stage heat pumps (e.g. a multistage heat pump for heating or cooling or a combination of a heating and cooling), according to the first aspect of the present invention, in the extraction of heat (e.g. hot or cold energy) from wastewater or other residual heat.

According to a preferred embodiment of the third aspect of the present invention, the renewable energy sources are selected from the group consisting of ambient air, freshwater, seawater, groundwater and the ground.

The multi-stage heat pump (e.g. a multistage heat pump for heating or cooling or a combination of a heating and cooling), according to embodiments of the present invention, is regarded as being an integral part of installations for the extraction of heat (e.g. hot or cold energy) from renewable energy sources e.g. in solar boilers and from the ambient air, groundwater and ground in horizontal or vertical ground source heat pumps (GSHP). The heat from the ground can either be provided by fairly shallow boreholes or very deep boreholes tapping into geothermal heat sources. For the relatively limited electricity consumption of a compressor, the heat (e.g. hot or cold energy) available in the air, freshwater, seawater, groundwater and the ground is transformed to heat (e.g. cold or hot energy) at a usable temperature. By using the multi-stage heat pump (e.g. a multistage heat pump for heating or cooling or a combination of a heating and cooling), according to embodiments of the present invention, the electricity consumption is substantially reduced over that required for single stage heat pumps which increases the efficiency with which energy can be extracted from renewable energy sources or other heat sources. Heat pumps (e.g. a multistage heat pump for heating or cooling or a combination of a heating and cooling), can be used in the heating (or cooling) of buildings in the residential sector, offices, hospitals and in industry. In addition to the heating (or cooling) of buildings, heat pumps (e.g. a multistage heat pump for heating or cooling or a combination of a heating and cooling), can also be utilised to lift or sink the temperature of low grade waste heat (hot energy or cold energy) to usable temperature levels. Part of the waste heat (hot or cold energy) which is now disposed of can be used in the process or for the provision of central heating (or cooling) were the temperature thereof to have been higher (or lower) whereby a heat pump (e.g. a multistage heat pump for heating or cooling or a combination of a heating and cooling), according to embodiments of the present invention can be used.

Embodiments of the present invention which provide an integrated multi-stage system expand the application possibilities and energy savings.

In addition to heating applications the heat pumps, according to the present application, can be used in cooling applications e.g. industrial, commercial, HVAC and air-conditioning. With multi-stage cooling systems the electricity consumption can be reduced over that with the classical single stage cooling systems.

In addition the heat pumps, according to the present application, can be used for both heating and cooling applications e.g. cooling part of the office with sun radiation and heating part off the office without sun radiation. Analogous to multistage heat pumps the present invention also includes multistage Rankine cycle engines. The use of multiple cycles can also here result in a higher efficiency. With the same amount of rest or geothermal heat thus more electricity can be generated. There are four processes in the Rankine cycle.

Process 1: The working fluid is pumped from low to high pressure. As the fluid is a liquid at this stage the pump requires little input energy.

Process 2: The high pressure liquid enters a boiler where it is heated at constant pressure by an external heat source to become a dry saturated vapour or superheated vapour.

Process 3: The dry saturated vapor expands through a turbine, generating power. This decreases the temperature and pressure of the vapour, and some condensation may occur.

Process 4: The wet vapour then enters a condenser where it is condensed at a constant pressure to become a saturated liquid.

Also it is advantageous to bring the vapour at the suction side of each compressor to a saturated or close to saturated state, because this will increase the efficiency of the compression of the vapour.

In an ideal Rankine cycle the pump and turbine would be isentropic, i.e., the pump and turbine would generate no entropy and hence maximize the net work output. Processes 1-2 and 3-4 would be represented by vertical lines on the T-S diagram and more closely resemble that of the Carnot cycle. The Rankine cycle shown here prevents the vapor ending up in the superheat region after the expansion in the turbine, which reduces the energy removed by the condensers.

It is to be understood that although preferred embodiments, specific constructions and configurations, as well as materials, have been discussed herein for devices according to the present invention, various changes or modifications in form and detail may be made without departing from the scope and spirit of this invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A multi-stage heat engine comprising:

an evaporator and a condenser;

an expander section including more than two expander stages;

a compressor section comprising more than two vapor compression stages that co-operate with the expander section;

x tanks, wherein x is at least three for holding gaseous phases and liquid phases of a fluid;

the expander section having x−1 expansion valves, the compressor section being adapted to compress the gaseous phase from a first tank to a higher pressure and to move the compressed fluid to a second next adjacent tank at a higher pressure, the expander section being adapted to move a part of the compressed fluid from the second next adjacent tank, through the expansion valve of that tank, to expand the fluid in the first tank at a lower pressure, the compressor and expander sections being adapted to output the gaseous phase at the highest pressure to the condenser and the liquid phase at the lowest pressure to the evaporator, the output of the condenser being fed back to the tank at the highest pressure and the output of the evaporator being fed back to the tank at the lowest pressure, wherein the expansion of the fluid in the first tank at a lower pressure brings the vapor in this latter tank to a saturated state, wherein each tank has a temperature sensor, and optionally a pressure sensor and/or liquid level sensor, wherein said expansion valves are controllable expansion valves, the heat engine further comprising a controller configured to regulate the controllable expansion valves in accordance with outputs of at least the temperature sensor to maintain a level of liquid in each tank and maintain the vapor of each tank in a saturated state.

2. The multi-stage heat engine according to claim 1, wherein vapor at a suction side of each compressor is brought to a saturated or close to saturated state.

3. The multi-stage heat engine, according to claim 1, adapted so that the compression of vapor from the first tank places the compressed vapor in a superheated state.

4. The multi-stage heat engine according to claim 1, adapted so that at every compression stage where there is expansion of some liquid returned from a higher pressure tank, the cooling effect of this expansion keeps the vapor in that tank at or close to saturated.

5. The multi-stage heat engine according to claim 1, wherein the compressor section comprises a group of or all compressors driven axially by a single motor.

6. The multi-stage heat engine according to claim 1, wherein a direct connection is provided between the pressure vessel and the pressure step in the compressor for each stage of the multi-stage heat engine.

7. The multi-stage heat engine according to claim 1, wherein said multi-stage heat engine is integrated.

8. The multi-stage heat engine according to claim 1, wherein said multi-stage heat engine is a multistage heat pump or in an analogous way a multistage Rankine cycle engine.

9. The multi-stage heat engine according to claim 1 adapted so that on heating or cooling a liquid medium, heat can be exchanged in steps, whereby the temperature difference between cooling or heating medium and the medium to be cooled or heated is more or less constant.

10. The multi-stage heat engine according to claim 1 adapted so that cooling energy or heating energy is delivered to different consumers at different temperatures.

11. A process for increasing or decreasing the temperature of a medium, said process comprising the steps of: subjecting said medium to multiple evaporation compression condensation-expansion-cycles in a multi-stage heat engine according to claim 1.

12. The process according to claim 11, further comprising transformation of heat energy from renewable energy sources to higher temperatures or lower temperatures.

13. The process according to claim 12, wherein said renewable energy sources are selected from the group consisting of ambient air, freshwater, seawater, groundwater and the ground.

14. The process according to claim 11 further comprising transformation of heat from residual heat optionally wastewater to higher temperatures or lower temperatures.

15. A multi-stage heat engine comprising:

an evaporator and a condenser;

an expander section including more than two expander stages;

a compressor section comprising more than two vapor compression stages that co-operate with the expander section;

x tanks wherein x is at least three for holding gaseous phases and liquid phases of a fluid;

the expander section having x−1 expansion valves, the compressor section being adapted to compress the gaseous phase from a first tank to a higher pressure and to move the compressed fluid to a second next adjacent tank at a higher pressure, the expander section being adapted to move a part of the compressed fluid from the second next adjacent tank, through the expansion valve of that tank, to expand the fluid in the first tank at a lower pressure, the compressor and expander sections being adapted to output the gaseous phase at the highest pressure to the condenser and the liquid phase at the lowest pressure to the evaporator, the output of the condenser being fed back to the tank at the highest pressure and the output of the evaporator being fed back to the tank at the lowest pressure, wherein the expansion of the fluid in the first tank at a lower pressure brings the vapor in this latter tank to a saturated state, wherein each tank has pressure, and/or temperature and/or liquid level sensors, wherein said expansion valves are controllable expansion valves, the heat engine further comprising a controller configured to regulate the controllable valves in accordance with the outputs of at least one of the sensors to maintain a level of liquid in each tank and maintain the vapor of each tank in the saturated state, wherein the x tanks are integrated in a whole by partitioning an enclosure into compartments, and wherein the vapor compression stages are arranged in between said compartments.

16. The multi-stage heat engine according to claim 15, wherein at every compression stage where there is expansion of some liquid returned from a higher pressure tank, the cooling effect of this expansion keeps the vapor in that tank at or close to saturated.

17. The multi-stage heat engine according to claim 15, wherein the compressor section comprises a group of or all compressors driven axially by a single motor.

18. The multi-stage heat engine according to claim 15, wherein a direct connection is provided between the pressure vessel and the pressure step in the compressor for each stage of the multi-stage heat engine.

* * * * *